US009833889B2

(12) United States Patent
Lee

(10) Patent No.: US 9,833,889 B2
(45) Date of Patent: Dec. 5, 2017

(54) NAIL-DRIVING GUN TRIGGER ASSEMBLY WITH SAFETY LATCH

(71) Applicant: Chung Heng Lee, New Taipei (TW)

(72) Inventor: Chung Heng Lee, New Taipei (TW)

( * ) Notice: Subject to any disclaimer, the term of this patent is extended or adjusted under 35 U.S.C. 154(b) by 520 days.

(21) Appl. No.: 14/604,100

(22) Filed: Jan. 23, 2015

(65) Prior Publication Data

US 2016/0214247 A1 Jul. 28, 2016

(51) Int. Cl.
*B25C 1/00* (2006.01)

(52) U.S. Cl.
CPC ..... *B25C 1/008* (2013.01)

(58) Field of Classification Search
CPC ..... B25C 1/008; B25C 1/143; B25C 1/043; B25C 1/047; H01H 9/06; F41B 7/08
USPC ..... 227/8, 9, 10
See application file for complete search history.

(56) References Cited

U.S. PATENT DOCUMENTS 4,565,312 A * 1/1986 Berry ..... B25C 1/105 227/10
4,598,851 A * 7/1986 Kopf ..... B25C 1/008 227/10
5,273,198 A * 12/1993 Popovich ..... B25C 1/143 227/10
6,929,165 B1 * 8/2005 Chen ..... B25C 1/008 227/142
7,152,773 B2 * 12/2006 Ke ..... B25C 1/043 227/130
2011/0057014 A1 * 3/2011 Yang ..... B25C 1/008 227/8
2012/0037683 A1 * 2/2012 Lee ..... B25C 1/143 227/10

* cited by examiner

*Primary Examiner* — Thanh Truong
*Assistant Examiner* — Nicholas Igbokwe
(74) *Attorney, Agent, or Firm* — John A. Fortkort; Fortkort & Houston PC

(57) ABSTRACT

A nail-driving gun trigger assembly includes a hand-grip, a trigger piece, a safety latch and a release button. The safety latch is mounted on the trigger piece and is movable relative to the trigger piece. The release button is mounted on the trigger piece and is movable relative to the trigger piece. The release button and the safety latch are co-movable with the trigger piece relative to the hand-grip. The trigger piece is stopped from moving by engagement between the safety latch and the hand-grip. The release button is in sliding contact with the safety latch for disengaging the safety latch from the hand-grip and for permitting movement of the trigger piece relative to the hand-grip.

9 Claims, 8 Drawing Sheets

NAIL-DRIVING GUN TRIGGER ASSEMBLY WITH SAFETY LATCH

FIELD OF THE INVENTION

This invention relates to a nail-driving gun trigger assembly, more particular to a nail-driving gun trigger assembly with a safety latch and a release button which are mounted movably to a trigger piece.

BACKGROUND OF THE INVENTION

U.S. Pat. No. 4,565,312 discloses a conventional powder actuated tool with safety. The conventional powder actuated tool includes a housing, a barrel, and a firing mechanism. The housing has a breech portion, a cradle portion telescopically connected to the breech portion, and a grip part extending from the breech portion. The barrel is mounted movably in the cradle portion, has an insert formed with a firing chamber for receiving an explosive powder cartridge, and defines a bore for receiving a fastener-driving ram. The firing mechanism includes a breech block, a firing pin and a trigger. A firing pin pawl is mounted in a blind hole in the firing pin, and is biased by a spring into a slot in the breech block. The slot has a searing surface that engages the firing pin pawl. A stop member is pivoted to the cradle portion, and has a tongue urged by a spring to protrude into a bore in the cradle portion to abut against the barrel, thereby preventing movement of the barrel relative to the cradle portion toward the breech block for positioning the explosive powder cartridge at a ready-to-fire position. Hence, the stop member can reduce the incidence of accidental drop fire.

In order to cock the tool and fire it, an operator must use one hand to depress the stop member to move the tongue out of the bore in the cradle portion to permit positioning of the explosive powder cartridge at the ready-to-fire position, and use the other hand to grasp the grip part to enable finger actuation of the trigger. Pulling the trigger causes the firing pin pawl to move into the blind bore and to disengage the searing surface, thereby releasing the firing pin from the searing surface and permitting movement of the firing pin, which is urged by a spring, toward the explosive powder cartridge.

Although the purpose of using both hands to cock and fire the tool is for safety considerations, it also causes inconvenience.

SUMMARY OF THE INVENTION

Therefore, an object of the present invention is to provide a nail-driving gun trigger assembly that can overcome the aforesaid drawback associated with the prior art.

According to the present invention, there is provided a nail-driving gun trigger assembly that comprises: a gun housing including a hand-grip that defines an inner space and a window opening which is in spatial communication with the inner space; a trigger mechanism including a trigger piece, a safety latch, and a release button, the trigger piece extending through the window opening into the inner space and being movable relative to the hand-grip between a non-actuating position and an actuating position, the safety latch being mounted movably on the trigger piece and being movable relative to the trigger piece between locked and unlocked positions, the release button being mounted movably on the trigger piece and being movable relative to the trigger piece between first and second positions, the release button and the safety latch being co-movable with the trigger piece relative to the hand-grip when the trigger piece is moved between the non-actuating and actuating positions; and an urging unit for restoring the trigger piece to the non-actuating position, the safety latch to the locked position, and the release button to the first position. The trigger piece is stopped from moving from the non-actuating position to the actuating position by engagement between the safety latch and the hand-grip when the safety latch is disposed at the locked position. The release button is in sliding contact with the safety latch so as to push the safety latch to move from the locked position to the unlocked position when the release button is pushed to move from the first position to the second position, thereby disengaging the safety latch from the hand-grip and permitting movement of the trigger piece together with the safety latch and the release button from the non-actuating position to the actuating position.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

FIGS. 1 to 6 illustrate the embodiment of a nail-driving gun trigger assembly according to the present invention.

Figure 1:
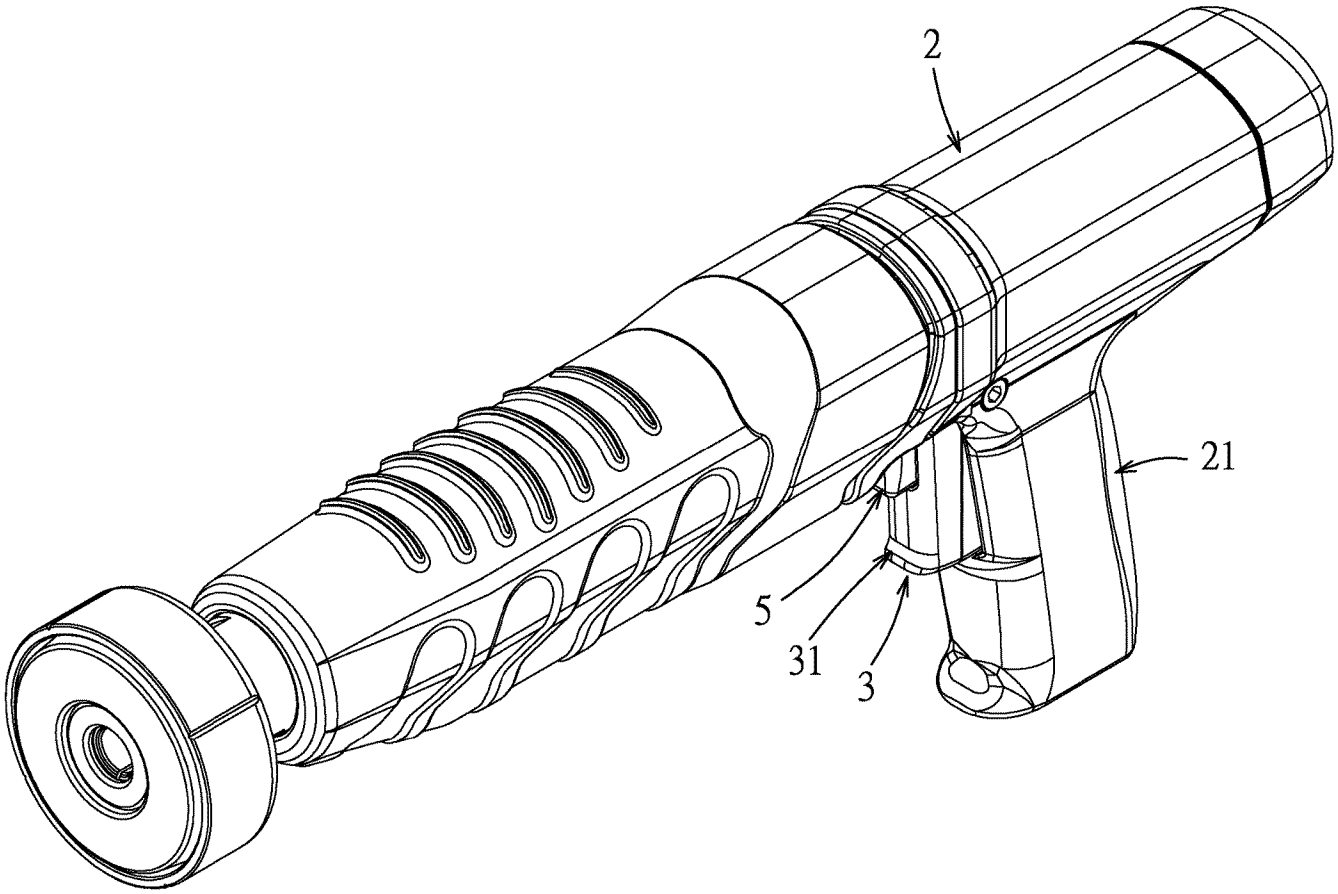
FIG. 1 is a perspective view of the embodiment of a nail-driving gun trigger assembly according to the present invention.
Figure 2:
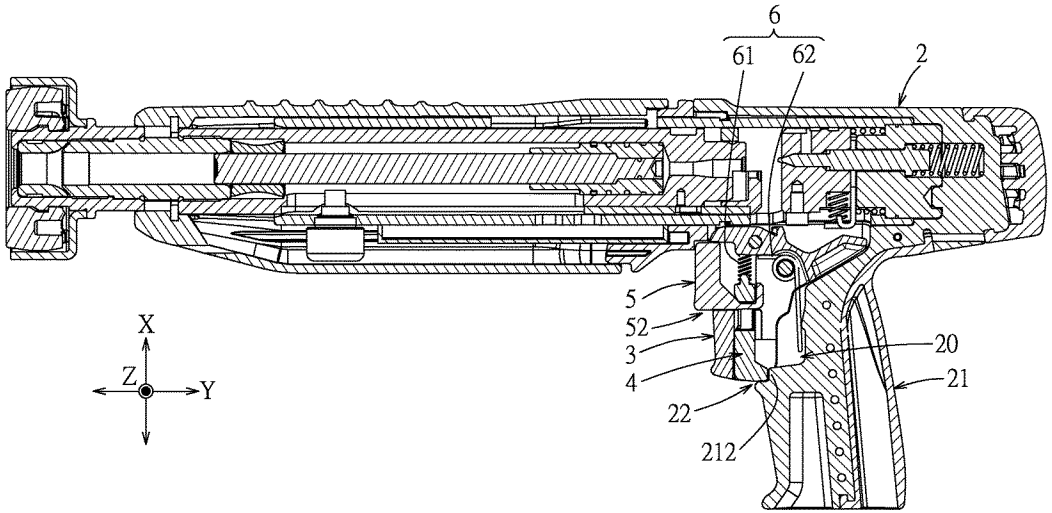
FIG. 2 is a sectional view of the embodiment.
Figure 3:
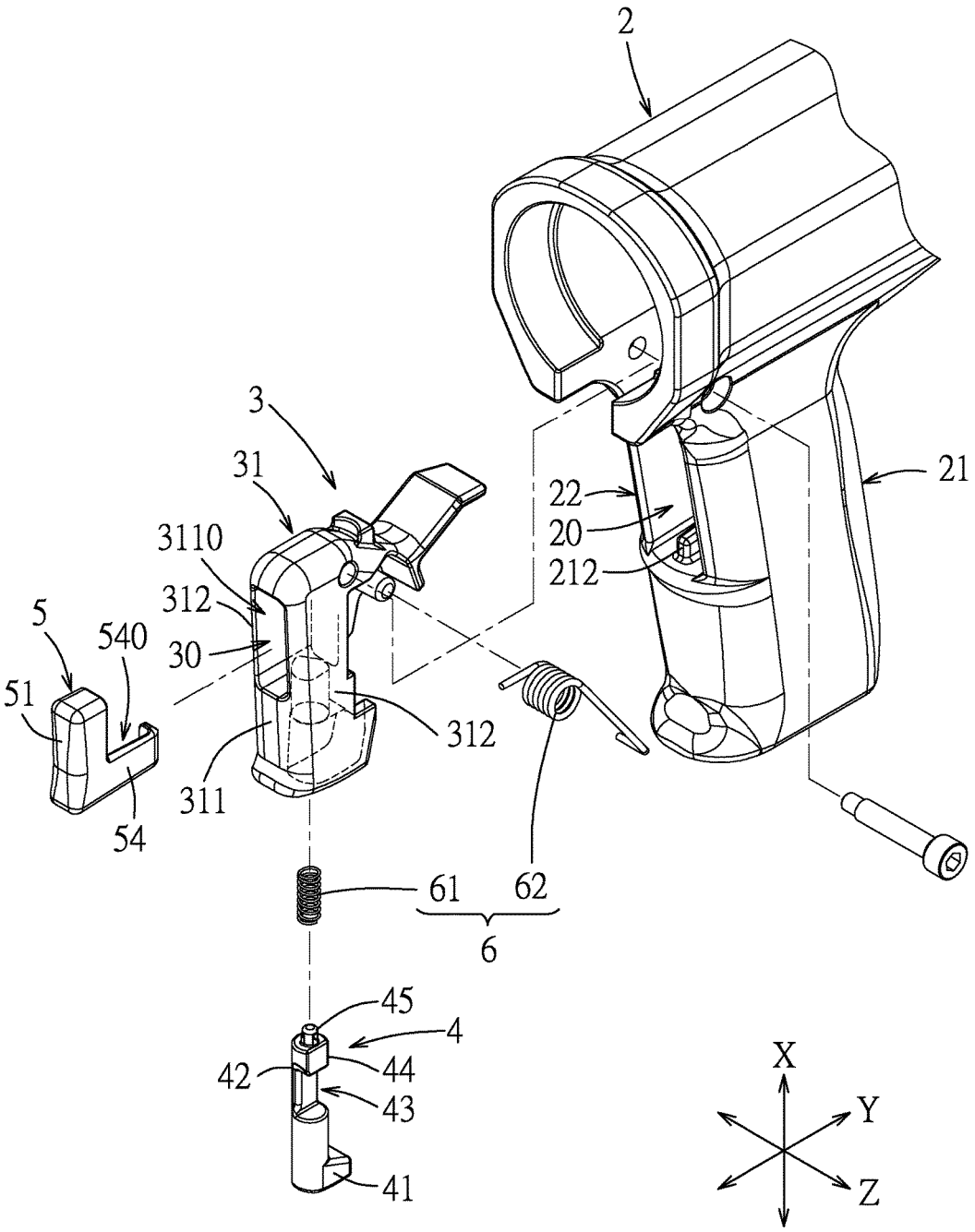
FIG. 3 is a fragmentary exploded perspective view of the embodiment.
Figure 4:
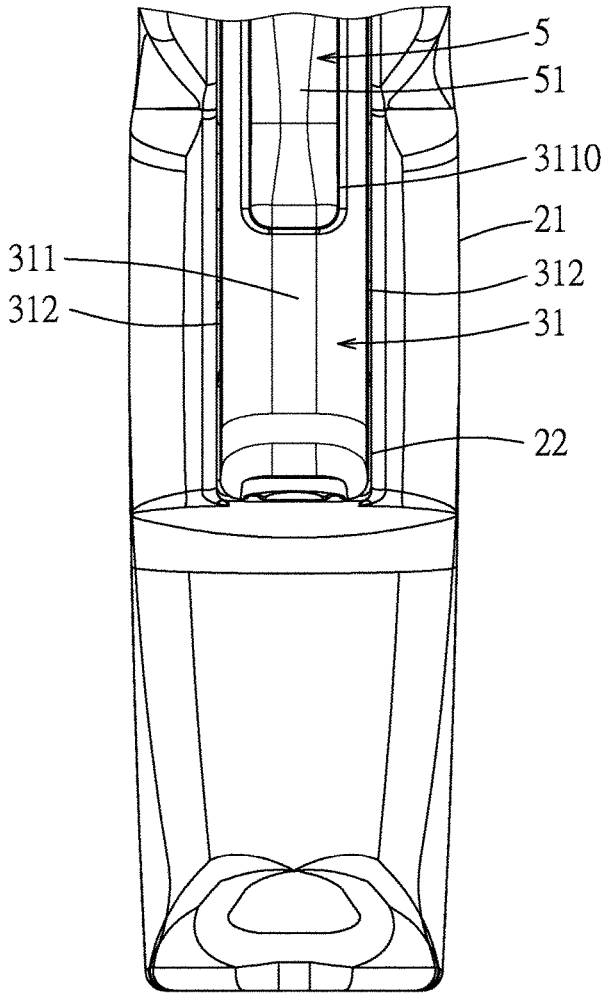
FIG. 4 is a fragmentary schematic front view of the embodiment.
Figure 5:
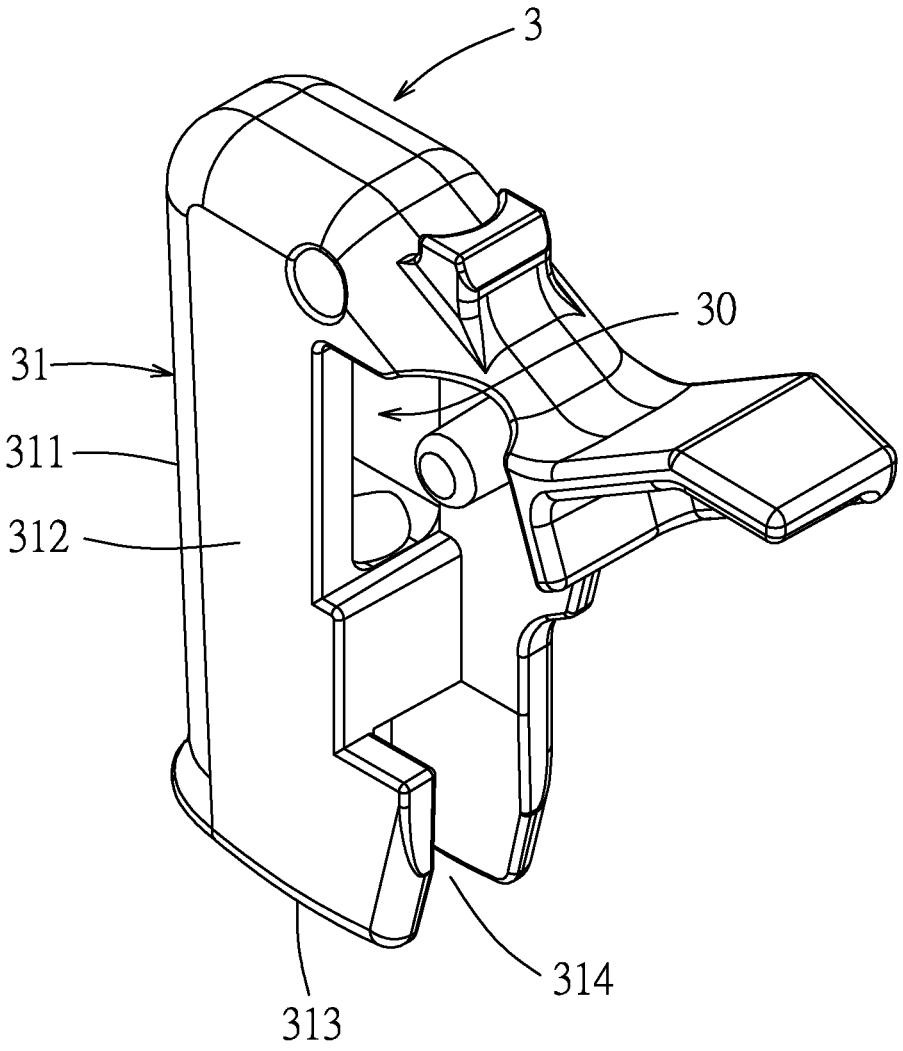
FIG. 5 is a perspective view of a trigger piece of the embodiment.
Figure 6:
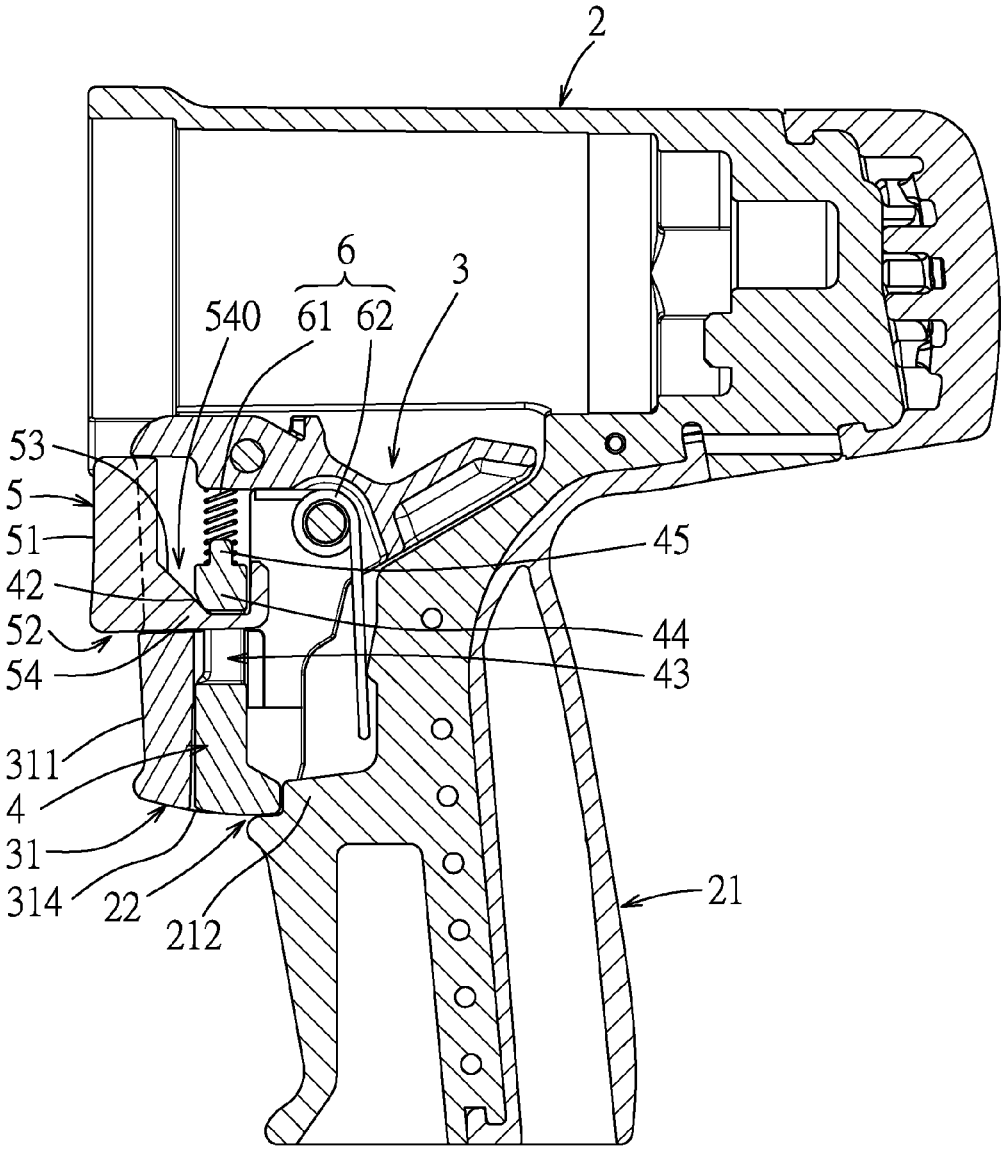
FIG. 6 is a fragmentary sectional view of the embodiment to illustrate a first state where a release button is disposed at a first position, a safety latch is disposed at a locked position, and the trigger piece is disposed at a non-actuating position.
Figure 7:
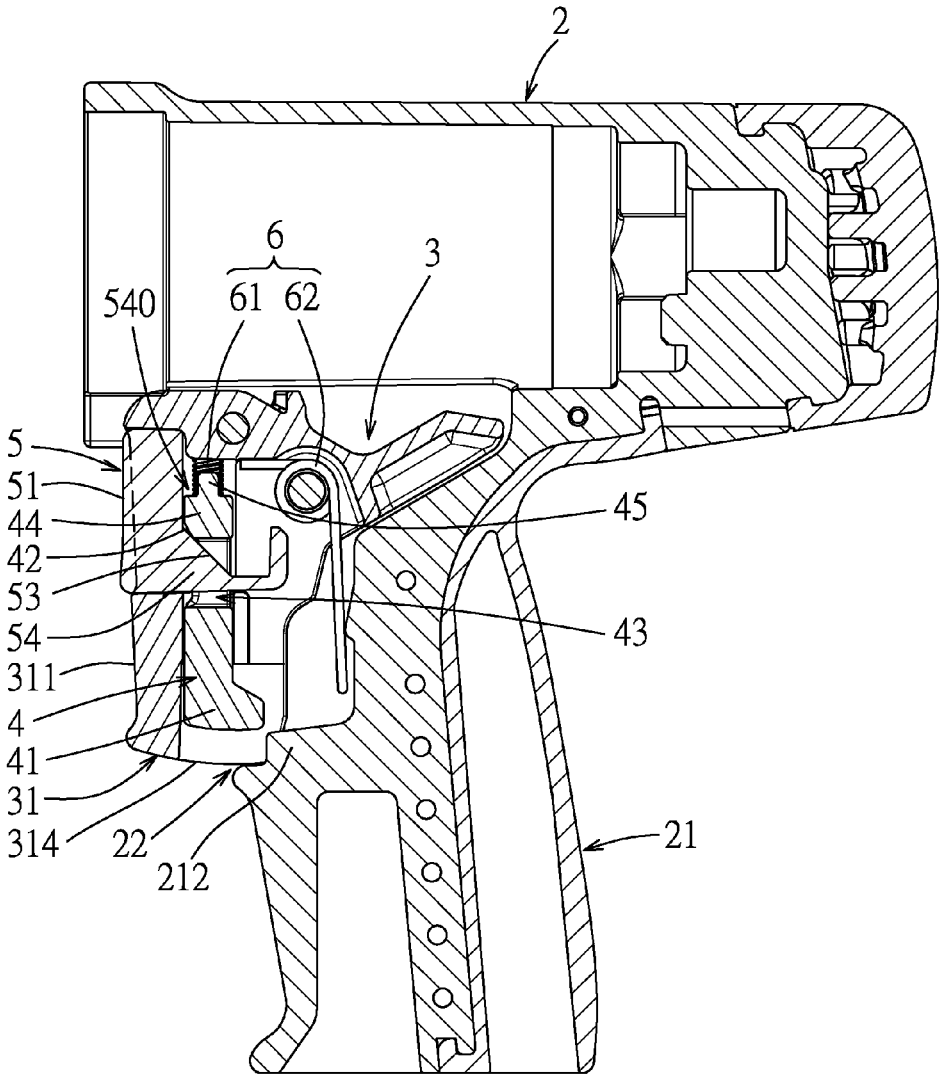
FIG. 7 is a fragmentary sectional view of the embodiment to illustrate a second state where the release button is disposed at a second position, the safety latch is disposed at a unlocked position, and the trigger piece is disposed at the non-actuating position.
Figure 8:
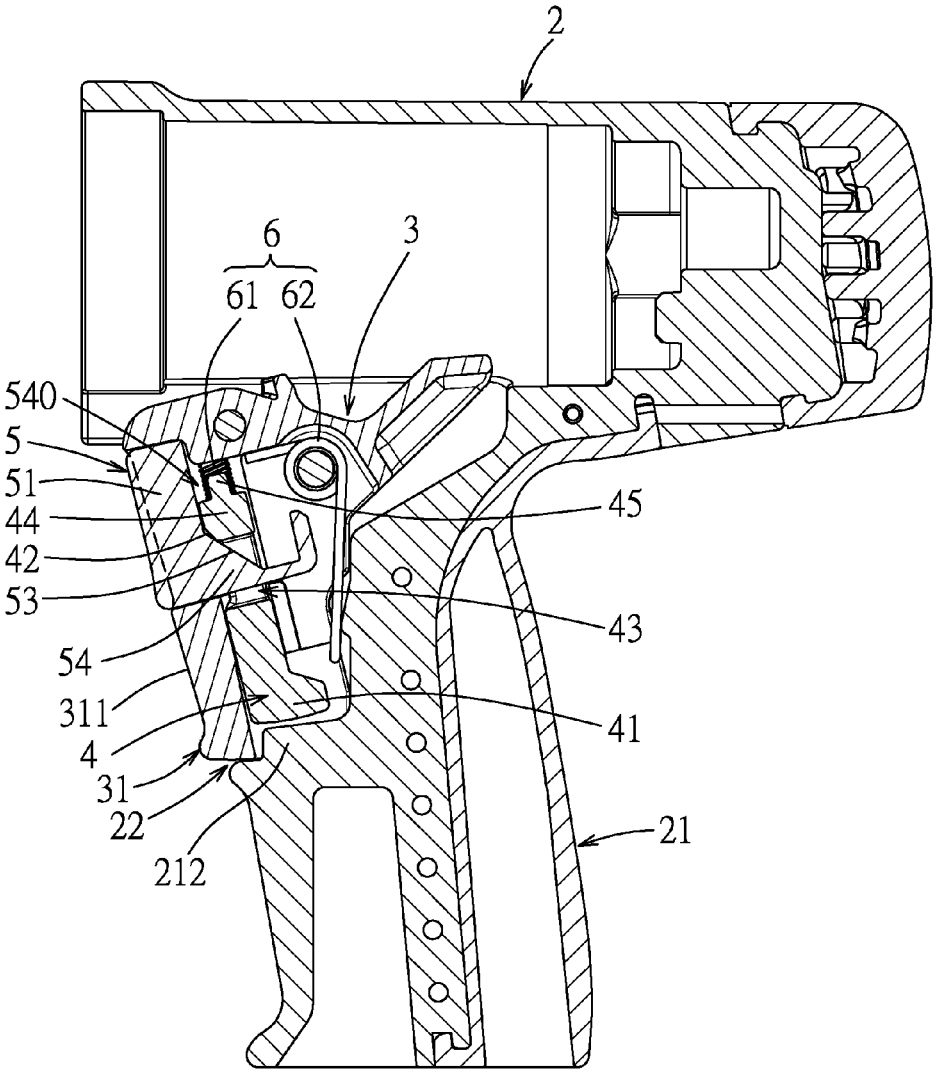
FIG. 8 is a fragmentary sectional view of the embodiment to illustrate a third state where the release button is disposed at the second position, the safety latch is disposed at the locked position, and the trigger piece together with the release button and the safety latch is disposed at an actuating position.

The nail-driving gun trigger assembly includes a gun housing 2, a trigger mechanism, and an urging unit 6. The gun housing 2 includes a hand-grip 21 that defines an inner space 20 and a window opening 22 which is in spatial communication with the inner space 20. The trigger mechanism includes a trigger piece 3, a safety latch 4, and a release button 5. The trigger piece 3 extends through the window opening 22 into the inner space 20, and is movable relative to the hand-grip 21 between a non-actuating position (see FIG. 7) and an actuating position (see FIG. 8). The safety latch 4 is mounted movably on the trigger piece 3, and is movable relative to the trigger piece 3 between locked and unlocked positions (see FIGS. 6 and 7). The release button 5 is mounted movably on the trigger piece 3, and is movable relative to the trigger piece 3 between first and second positions (see FIGS. 6 and 7). The release button 5 and the safety latch 4 are co-movable with the trigger piece 3 relative to the hand-grip 21 when the trigger piece 3 is moved between the non-actuating and actuating positions. The urging unit 6 includes a latch spring 61 and a trigger spring 62 for restoring the trigger piece 3 to the non-actuating position, the safety latch 4 to the locked position, and the release button 5 to the first position.

The trigger piece 3 is stopped from moving from the non-actuating position to the actuating position by engagement between the safety latch 4 and the hand-grip 21 when the safety latch 4 is disposed at the locked position. The release button 5 is in sliding contact with the safety latch 4 so as to push the safety latch 4 to move from the locked position to the unlocked position when the release button 5 is pushed to move from the first position to the second position, thereby disengaging the safety latch 4 from the hand-grip 21 and permitting movement of the trigger piece 3 together with the safety latch 4 and the release button 5 from the non-actuating position to the actuating position.

In this embodiment, the trigger piece 3 has an operating protrusion 31 that protrudes frontwardly and outwardly of the window opening 22 and that has a trigger-front wall 311. The release button 5 is disposed adjacent to the trigger-front wall 311, and has a button-front wall 51 that is disposed frontwardly of the trigger-front wall 311, so that a user can place two fingers of one hand one behind the other respectively on the trigger-front wall 311 and the button-front wall 51 for pressing thereon.

The safety latch 4 is movable relative to the trigger piece 3 between the locked and unlocked positions along a first direction (X). The release button 5 is movable relative to the trigger piece 3 between the first and second positions along a second direction (Y) transverse to the first direction (X). The arrangement of the safety latch 4 and the release button 5 on the trigger piece 3 and of the moving directions of the safety latch 4 and the release button 5 relative to the trigger piece 3 facilitate prevention of the incidence of drop fire.

The trigger piece 3 is pivoted to the hand-grip 21 so as to be rotatable relative to the hand-grip 21 about an axis (Z) between the non-actuating and actuating positions. The axis (Z) is transverse to the first and second directions (X, Y).

The operating protrusion 31 is hollow, defines a chamber 30, and further has two opposite side walls 312 that extend rearwardly from the trigger-front wall 311 and that are spaced apart from each other, and a bottom wall 313 (see FIG. 8) that is connected to the trigger-front wall 311 and the side walls 312 and that is formed with a bottom hole 314. The trigger-front wall 311 is formed with a front hole 3110. The release button 5 extends through the front hole 3110 and into the chamber 30 in the operating protrusion 31, protrudes outwardly and frontwardly of the front hole 3110, and cooperates with the trigger-front wall 311 to define a step 52 therebetween so that the trigger-front wall 311 is one step below and behind the button-front wall 51. As such, when the user places his or her two fingers of one hand respectively on the trigger-front wall 311 and the button-front wall 51, one of the two fingers which is placed on the button-front wall 51 is disposed in front of and one step above the other of the two fingers which is placed on the trigger-front wall 311.

The hand-grip 21 is formed with a stopper 212 that is disposed above the bottom hole 314 in the bottom wall 313 of the operating protrusion 31, and that is disposed adjacent to a lower end of the window opening 22. The safety latch 4 is disposed in the operating protrusion 31, and has a bottom end portion 41 that is disposed adjacent to the stopper 212. The bottom end portion 41 of the safety latch 4 may contact and be blocked by the stopper 212 when the safety latch 4 is disposed at the locked position and when the trigger piece 3 is disposed at the non-actuating position or may be brought into contact with the stopper 212 when the safety latch 4 is disposed at the locked position and is moved together with the trigger piece 3, thereby preventing movement of the trigger piece 3 from the non-actuating position to the actuating position, and is disposed above and released from the stopper 212 when the safety latch 4 is disposed at the unlocked position, thereby permitting movement of the trigger piece 3 from the non-actuating position to the actuating position. The bottom end portion 41 extends into the bottom hole 314 when the safety latch 4 is disposed at the locked position, and is disposed above the bottom hole 314 and the stopper 212 when the safety latch 4 is disposed at the unlocked position.

The release button 5 has a cam surface 53 that is inclined to the first and second directions (X, Y). The safety latch 4 has a cam follower surface 42 that is inclined to the first and second directions (X, Y). The cam surface 53 is in sliding contact with the cam follower surface 42 for driving movement of the safety latch 4 relative to the trigger piece 3.

The safety latch 4 is formed with a notch 43, and has an upper end portion 44 that is received in the chamber 30 and that confines a top side of the notch 43. The release button 5 has a hook-shaped arm portion 54 that extends through the notch 43 and that defines a groove 540. The upper end portion 44 of the safety latch 4 extends into the groove 540, and defines the cam follower surface 42. The arm portion 54 defines the cam surface 53 that confines one side of the groove 540.

The safety latch 4 together with the trigger piece 3 is released from the stopper 212 and the step 52 ceases to exist when the button-front wall 51 is moved to flush substantially with the trigger-front wall 311. The one-step-behind arrangement between the trigger-front wall 311 and the button-front wall 51 facilitates unlocking and pulling operations of the trigger piece 3. In addition, the requirement of using two fingers for operating the trigger piece 3 also provides a safety feature for preventing accidental firing due to accidental touching of the trigger-front wall 311 of the trigger piece 3.

The upper end portion 44 of the safety latch 4 is formed with an upper stud 45. The latch spring 61 is in the form of a coil spring, is mounted on the upper stud 45, and abuts against the upper end portion 44 and the trigger piece 3. The trigger spring 62 is in the form of a torsion spring, is mounted on the trigger piece 3, and abuts against the trigger piece 3 and the hand-grip 21.

By movably mounting the safety latch 4 and the release button 5 on the trigger piece 3 of the nail-driving gun trigger assembly, the aforesaid drawback associated with the prior art can be alleviated.

While the present invention has been described in connection with that is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A nail-driving gun trigger assembly comprising:

a gun housing including a hand-grip that defines an inner space and a window opening which is in spatial communication with said inner space;

a trigger mechanism including a trigger piece, a safety latch, and a release button, said trigger piece extending through said window opening into said inner space and being movable relative to said hand-grip between a non-actuating position and an actuating position, said safety latch being mounted movably on said trigger piece and being movable relative to said trigger piece between locked and unlocked positions, said release button being mounted movably on said trigger piece and being movable relative to said trigger piece between first and second positions, said release button and said safety latch being co-movable with said trigger piece relative to said hand-grip when said trigger piece is moved between said non-actuating and actuating positions; and an urging unit for restoring said trigger piece to said non-actuating position, said safety latch to said locked position, and said release button to said first position;

wherein said trigger piece is stopped from moving from said non-actuating position to said actuating position by engagement between said safety latch and said hand-grip when said safety latch is disposed at said locked position; and wherein said release button is in sliding contact with said safety latch so as to push said safety latch to move from said locked position to said unlocked position when said release button is pushed to move from said first position to said second position, thereby disengaging said safety latch from said hand-grip and permitting movement of said trigger piece together with said safety latch and said release button from said non-actuating position to said actuating position.

2. The nail-driving gun trigger assembly of claim 1, wherein said trigger piece has an operating protrusion that protrudes frontwardly and outwardly of said window opening and that has a trigger-front wall, said release button being disposed adjacent to said trigger-front wall and having a button-front wall that is disposed frontwardly of said trigger-front wall, so that a user can place two fingers of one hand, one finger behind the other respectively on said trigger-front wall and said button-front wall for pressing thereon.

3. The nail-driving gun trigger assembly of claim 2, wherein said safety latch is movable relative to said trigger piece between said locked and unlocked positions along a first direction, said release button being movable relative to said trigger piece between said first and second positions along a second direction transverse to said first direction.

4. The nail-driving gun trigger assembly of claim 3, wherein said trigger piece is pivoted to said hand-grip so as to be rotatable relative to said hand-grip about an axis between said non-actuating and actuating positions, said axis being transverse to said first and second directions.

5. The nail-driving gun trigger assembly of claim 2, wherein said operating protrusion is hollow, and further has two opposite side walls that extend rearwardly from said trigger-front wall and that are spaced apart from each other, said trigger-front wall being formed with a front hole, said release button extending through said front hole and into said operating protrusion, protruding outwardly of said front hole, and cooperating with said trigger-front wall to define a step therebetween.

6. The nail-driving gun assembly of claim 5, wherein said hand-grip is formed with a stopper that is disposed adjacent to said window opening, said safety latch having a bottom end portion that is disposed adjacent to said stopper, said bottom end portion being blocked by said stopper when said safety latch is disposed at said locked position and said bottom end portion being disposed above and released from said stopper when said safety latch is disposed at said unlocked position.

7. The nail-driving gun assembly of claim 3, wherein said release button has a cam surface that is inclined to said first and second directions, said safety latch having a cam follower surface that is inclined to said first and second directions, said cam surface being in sliding contact with said cam follower surface for driving movement of said safety latch relative to said trigger piece.

8. The nail-driving gun assembly of claim 7, wherein said safety latch is formed with a notch and has an upper end portion that confines a top side of said notch, said release button having a hook-shaped arm portion that extends through said notch and that defines a groove, said upper end portion of said safety latch extending into said groove and defining said cam follower surface, said hook-shaped arm portion defining said cam surface that confines one side of said groove.

9. The nail-driving gun assembly of claim 8, wherein said urging unit includes a latch spring and a trigger spring, said upper end portion of said safety latch being formed with an upper stud, said latch spring being mounted on said upper stud and abutting against said upper end portion of said trigger piece, and said trigger spring being mounted on said trigger piece and abutting against said trigger piece and said hand-grip.

* * * * *